US006173448B1

(12) United States Patent
Kroposky

(10) Patent No.: US 6,173,448 B1
(45) Date of Patent: Jan. 16, 2001

(54) LEG PROTECTOR

(76) Inventor: Anthony E. Kroposky, 25 Park Ave., South Somerville, NJ (US) 08876-4120

( * ) Notice: Under 35 U.S.C. 154(b), the term of this patent shall be extended for 0 days.

(21) Appl. No.: 09/411,114

(22) Filed: Oct. 4, 1999

(51) Int. Cl.[7] ..... A41D 13/06
(52) U.S. Cl. ..... 2/22; 2/46; 2/242
(58) Field of Search ..... 2/22, 24, 16, 242, 2/455, 911, 46; 36/1.5, 2 R

(56) References Cited

U.S. PATENT DOCUMENTS 3,153,864 * 10/1964 Brewer ..... 36/2 R
5,613,250 * 3/1997 Bell ..... 2/242
5,732,411 * 3/1998 Coleman et al. ..... 2/22
5,742,938 * 4/1998 Winningham et al. ..... 2/22
5,970,525 * 10/1999 Gallinot et al. ..... 2/242

* cited by examiner

*Primary Examiner*—John J. Calvert
*Assistant Examiner*—Tejash Patel
(74) *Attorney, Agent, or Firm*—Roger M. Rathbun

(57) ABSTRACT

A protector for the lower portion of a users leg that is made of a trough, flexible material, preferably leather, that substantially encircles the users leg to protect that leg from being injured by the plastic cord of a weed trimmer. The protector has a lower portion that extends over the upper surface of the users foot and the generally cylindrically shaped protector extends upwardly to just below the knee of the user.

4 Claims, 2 Drawing Sheets

LEG PROTECTOR

BACKGROUND

This invention relates to a protector for a person's leg for use when that person is utilizing a common grass trimming device. In such devices, a plastic cord extends from a spinning rotor and which is moved by the user into position to cut weeds, grass or other vegetation. In order to have sufficient speed and strength to cut fairly large weeds, the cord must be fairly substantial and the speed needs to be quite high. Typically, the rotor may be rotating at a high speed with the free end of the plastic cord extending outwardly from the rotor at least five or more inches and the plastic cord may have a diameter of about 0.095 of 0.080 inches in diameter. As such, the free end of the rotating plastic cord can be hazardous to the user in moving the unit about to trim the vegetation and often the user can experience a problem where the free end of the rotating cord actually strikes against the front of the users leg. The situation is aggravated, of course, where the user is on a short time schedule to finish the task and thus is hurrying to complete the trimming function as the last procedure in attending to a lawn.

As another source of injury, often the cord, rotating at such high speeds, can hit the ground and kick up debris, such as rocks, wood chips and the like that are then propelled by the cord against the leg of the user.

In many cases, the incident is painful to the user and in the case of professionals, the frequency of the occurrences can be more than annoying and can be considerably painful as the accidents can occur frequently in view of the rather lengthy periods of time that such users are employing the devices.

Obvious, the annoyance can be mitigated through the use of long trousers that are made of strong material, such as denim, however, since the activities of weed and grass trimming regularly occurs during the summer months, most users desire to wear shorts in view of the heat of the day. As such, therefore, the front of the users legs, from the upper surface of the foot to just below the knee is vulnerable to being cut by the plastic cord and can become infected to create a more serious health hazard. Also, the wounds from striking by the cord can leave scarring of the leg.

There are many different types of shin protectors used for various purposes, one of which is for baseball catchers to protect against being hit by a baseball, however such devices and protectors are generally made of relatively hard, inflexible plastic material in view of the speed at which the baseball is likely to hit the shin protector and are not well suited for use as protection against the plastic cord of weed trimmers. In addition, catchers shin guards are often quite cumbersome to attach and detach from the legs of the user and would not be convenient in the lawn care use.

Typical of such baseball shin protectors for catchers are shown in U.S. Pat. No. 4,474,157. There are also suitable protectors for batters as shown in U.S. Pat. No. 4,608,718 and which are heavily padded to guard against being injured by a pitched ball but such batter protectors do not extend upwardly to just below the knee and therefore would not be suitable for protection with the use of a weed trimmer. In addition, in U.S. Pat. No. Des. 306,921 that is an ankle and shin protector that is intended for protection for the side of an ankle and not the front of the ankle where damage from a weed trimmer is most likely to occur.

A still further type of protector for the lower leg is shown and described in U.S. Pat. No. 5,170,503 that comprises a protector against snake bites and which has no particular protection along the upper surface of the foot and is only intended to protect the lower portion of the leg where the likelihood of a snake bite is relatively high.

As such, while there are differing types of protectors for ankles, shins and the like as described, there are no protectors that are specifically adapted to be used as protection against the potential injury from weed trimmers of the type described.

Accordingly it would be advantageous to have a device to provide the needed protection to the user from potential injury from a weed trimmer.

SUMMARY OF THE INVENTION

The protector of the present invention provides safe protection against the possibility of cuts or abrasions incurred by the user of a weed trimmer and comprises a tough, flexible material that is formed in a generally cylindrical shape that is adapted to at least substantially encircle the lower leg of a person. The protector extends downwardly from just below the knee to the foot and additionally covers the upper surface of the foot of the user. Preferably, the material is of a thick planar leather material so that the protector can be easily molded to the shape of the lower leg as protection thereof but is sufficiently strong as to not be readily damaged by the multiple strikes or hits by the plastic cord of the weed trimmer.

In order to cover the upper surface of the users foot, a generally cylindrical shaped protector includes a truncated triangular portion formed centrally in the protector and which extends over the upper surface of the foot. Thus there is formed a front surface of the protector that surrounds the front of the lower leg of the user from just below the knee to the upper surface of the foot and has free ends that encircle the leg to be positioned at the back surface of the leg. A securing means is also provided to affix the protector to the users leg and to make the attaching and detaching of the protector to that leg to be easily facilitated. The securing means may comprise a strap affixed to one of the free ends with a VELCRO surface that adheres to the other free end of the protector. In the preferred embodiment, there are two straps since the protector is relatively long, that is, it extends from the upper surface of the foot to just below the knee and two straps are preferred to securely affix the protector to the leg of the user.

The foregoing and other advantages and features of the present invention will become readily apparent from the following description.

DETAILED DESCRIPTION OF THE INVENTION

Figure 1:
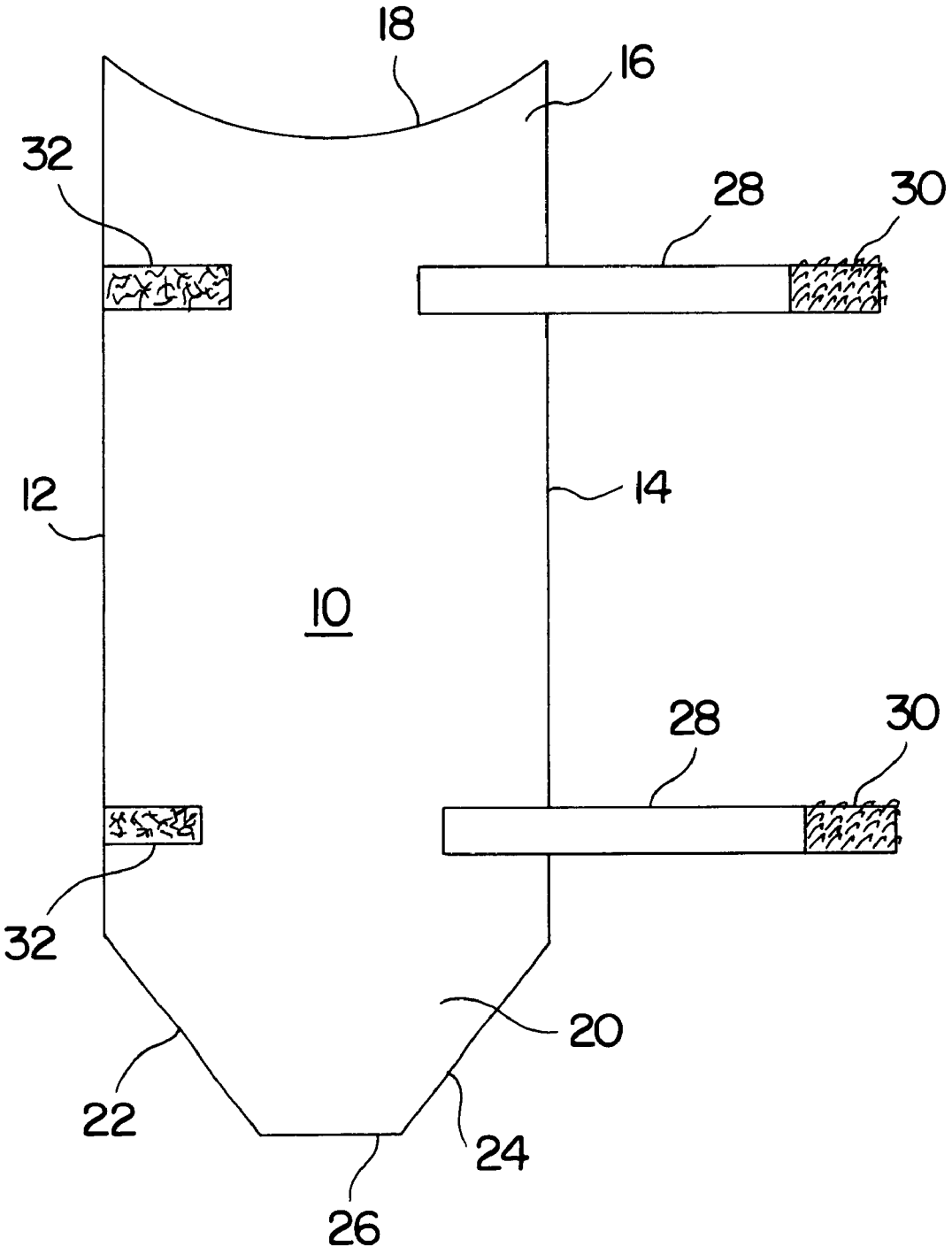
FIG. 1 is a front plan view of the lower leg protector constructed in accordance with the present invention.

Referring now to FIG. 1, there is shown a front plan view of the lower leg protector 10 constructed in accordance with the present invention. As can be seen, the form of the protector 10 includes two free ends 12 and 14 that, in use, encircle the leg of the user. At the upper end 16 of the protector 10 there may be a generally concave profile 18 so that the protector 10 will fit comfortable just under the knee. At the lower end 20 of the protector 10, there is formed a generally triangular shape having downwardly and inwardly directed sides 22 and 24 terminating in a flat bottom 26 representative of a triangle having its apex cut off or truncated.

The inward directed sides 22 and 24 are generally of equal length of the triangle shape and the flat bottom 26 is preferably in the center of the protector 10 between the free ends 12 and 14. Therefore, as will be obvious, the flat bottom 26, when in use, can extend over the upper surface of the users foot and provide protection to that area while the remaining area of the protector 10 will cover and protect the front and side areas of the lower leg from upper surface of the foot to just below the knee. As previously explained, that area is the most vulnerable to being hit by the rotating plastic cord of the weed trimmer or by debris thrown up by the cord and thus requires the protection.

A securing means is utilized to affix the protector 10 to the leg of a user and, as shown, the securing means may be a pair or straps 28 that are affixed to one of the free ends and which can have their ends comprised of a VELCRO material 30 to be securable to corresponding VELCRO material 32 affixed to the other of the free ends. As an alternative, the entire or substantially the entire length of one of the free ends may be fitted with the VELCRO material and the corresponding material affixed on the other of the free ends. The use of a lengthy VELCRO securing means or the use of a plurality of straps is needed in the present invention due to the length of the protector itself and the need, therefore, to retain it securely to the leg of the user.

The material of the protector 10 is preferably a flexible material so that it can be easily fitted around the leg of the user comfortably and be adapted to fit various size legs. The material also must be relatively strong so as to resist cutting or damage when hit by the plastic cord of the weed trimmer. In the preferred embodiment, the material is leather and which also allows some breathing so that the users leg does not become overheated from the presence of the protector 10 in hot weather.

Figure 2:
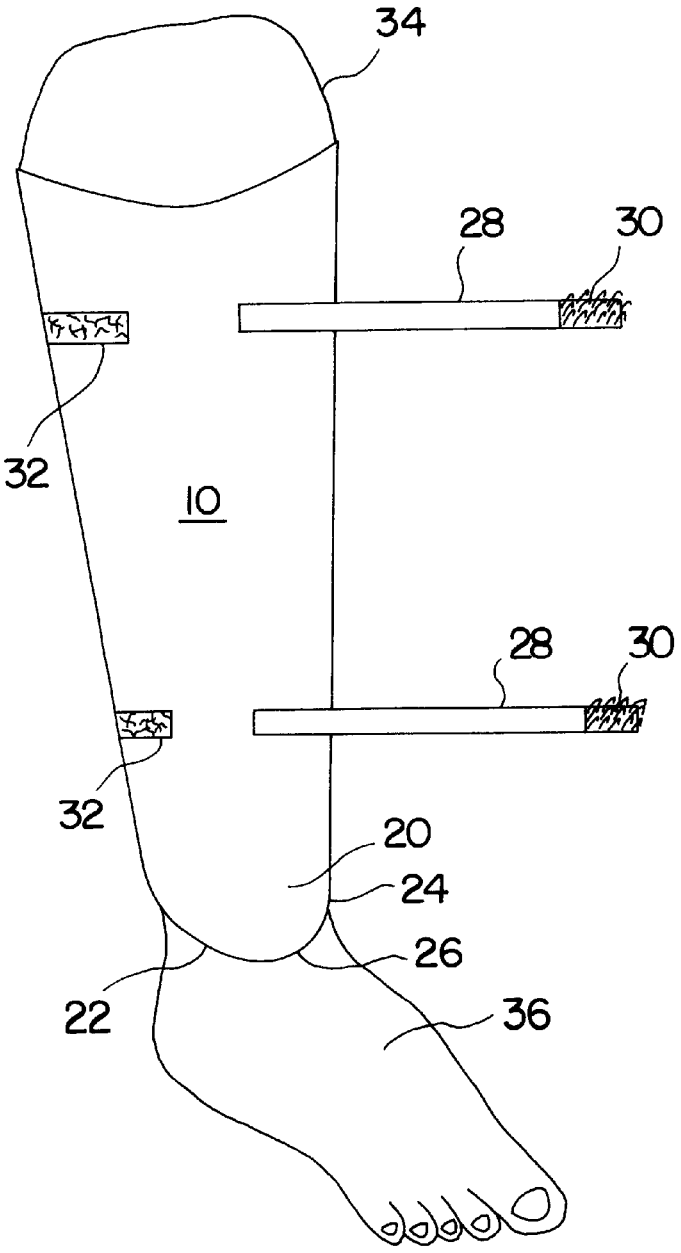
FIG. 2 is a front perspective view of the leg protector of FIG. 1 shown in position affixed to the leg of the user.

Turning now to FIG. 2, there is shown a front perspective view of the protector 10 of the present invention in position to be affixed to the leg of the user. Accordingly, the upper end 18 is located just under the knee 34 of the user and the lower end 20 is shown as covering the ankle of the user with the flat bottom 24 covering the upper surface of the foot 36. Obviously the remaining upper surface of the foot 36 is well covered by the shoe of the user, however, the flat bottom 26 provides a protective transition area between the shoe and the remaining area of the protector 10.

Figure 3:
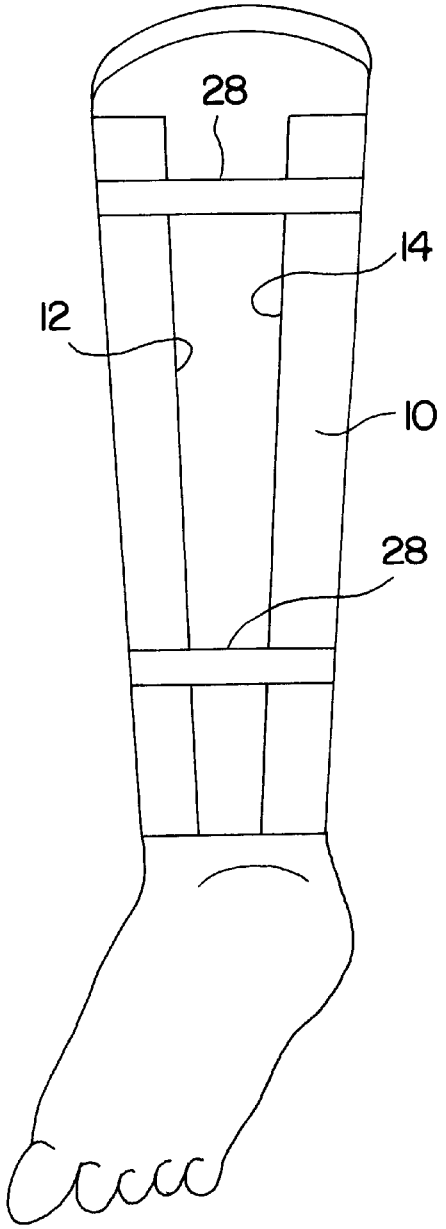
FIG. 3 is a rear perspective view of the leg protector affixed to the leg of a user.

Turning finally to FIG. 3, there is shown a rear perspective view of the protector 10 of the present invention affixed to the leg of a user. As can be seen, the flexible nature of the material of the protector 10 allows it to encircle the leg of the user and be readily secured to that leg by means of the securing means which, in the preferred embodiment, comprises the pair of straps 28 that join the free ends 12 and 14 of the protector 10 at the rear of the users leg.

Thus, the rear of the protector 10 need not cover the rear surface of the leg as that area of the leg is unlikely to be struck by the plastic cord of the weed trimmer and that rear area may allow an area of ventilation. In the preferred embodiment, the protector 10 encircles substantially the entire leg, and more preferably about three-quarters around the leg.

As such, it can now be seen that the invention provides protection to the lower leg from just below the knee to and including the upper surface of the foot of the user. The flexibility of the material allows the protector 10 to be shaped to the individual leg for comfort and convenience and the securing means is easily facilitated and yet holds the protector securely in place to the leg of the user.

While the above presents a working embodiment of the invention, there are others which will be obvious to those skilled in the art. The invention is not to be limited to the embodiments specifically described but is to be interpreted only in conjunction with the scope of the appended claims and their functional equivalents.

I claim:

1. A leg protector for covering the front and side portion of a person's leg from just below the person's knee to the upper surface of the foot, said leg protector comprising a tough flexible planar leather body adapted to be wrapped at least substantially around the leg of a person to form a curved continuous front surface and having a pair of free ends positioned at the back of the person's leg, said front surface having an upper portion having a generally concave profile with respect to the plane to fit just below the knee of a person and further having lower central portion configured in the shape of a truncated triangle to fit along and over the upper surface of the person's foot, and a securing means affixed to one of said free ends and attachable to the other of said free ends to secure said free ends together to retain said leg protector to a person's leg.

2. A leg protector as defined in claim 1 wherein said securing means comprises a plurality of straps affixed to said one free end and adapt to overlap and secure to said other free end.

3. A leg protector as defined in claim 2 wherein said plurality of straps each include hook and loop fasteners adapted to be affixed to a corresponding surface on said other free end.

4. A leg protector as defined in claim 1 wherein said lower portion comprises a pair of inwardly and downwardly directed sides of equal length ending in a bottom that is a flat profile.

* * * * *